US005509371A

United States Patent [19]

Phillips

[11] Patent Number: 5,509,371

[45] Date of Patent: Apr. 23, 1996

[54] FLAG HOLDING RINGS

[76] Inventor: Thomas E. Phillips, 111 E. Washington St., Princeton, Ill. 61356

[21] Appl. No.: 488,753

[22] Filed: Jun. 5, 1995

[51] Int. Cl.[6] ..... G09F 17/00

[52] U.S. Cl. ..... 116/173; 40/601

[58] Field of Search ..... 116/173–175; 40/218, 601

[56] References Cited

U.S. PATENT DOCUMENTS

| | | | |
|---|---|---|---|
| 1,295,274 | 2/1919 | Crichton | 116/174 |
| 2,225,103 | 12/1940 | Einermann | 116/173 |
| 3,417,732 | 12/1968 | Platt, Jr. | 116/173 |
| 3,595,202 | 7/1971 | Visitacion | 116/174 |
| 3,680,526 | 8/1972 | Buffington, Jr. | 116/174 |
| 3,826,223 | 7/1974 | Lingo, Jr. | 116/174 |
| 3,910,226 | 10/1975 | McGahee | 116/173 |

*Primary Examiner*—William A. Cuchlinski, Jr.
*Assistant Examiner*—Andrew Hirshfeld

[57] ABSTRACT

A set of ring shaped flag holders which surround a flag pole used to attach a flag to a flag rope. The flag eyelets rest over the rings and the flag is able to rotate around substantially the entire diameter of the pole without rubbing on it or wrapping around it. The flag is held close to the pole by the rings while it is moved up or down the pole or is hanging. Attaching the top flag holder is accomplished by slipping the ring through a simple loop configuration in the rope and pulling the rope tight forming an attractive and secure knot. Attaching the bottom flag holder is accomplished by simply slipping a slot in the ring over the rope. Attachment and removal of the flag is accomplished by hooks and eyes provided at opposite ends of the rings. When the eyes are engaged over the hooks the flag is locked on the rings; when it is unlocked the flag will easily slip off the rings. Construction of the rings is from a one piece wire form with no parts to stick or wear out.

20 Claims, 7 Drawing Sheets

FLAG HOLDING RINGS

BACKGROUND OF INVENTION

1. Field of Invention

The subject invention generally pertains to flag holders, and more specifically to flag holders attached to a rope, which is part of a rope and pulley system used to move flags up and down a flag pole, which hold the flag in hanging position at the top of or at some other point on the pole.

2. Description of Related Art

Current flag holders are generally made of a metal casting with a hook shape at one end and a hole at the other end. In addition a spring clip is attached to the casting at the end with the hole that extends to the point of the hook. To install or remove a flag the spring clip is bent into the hook leaving a space so that the eyelet in the flag can slide over the hook portion of the casting. When the flag is on or off as desired the spring clip is released and returns to its free position either holding the flag in position or not if it has been removed.

A variation of this design is an injection molded plastic part that substitutes a thin molded section for the spring clip portion of the above assembly.

A disadvantage of this design is that attachment to the rope can be difficult and confusing and as a result the job is sometimes finished with the appearance of the attachment less than desirable.

One method used is to insert a rope through the hole in the casting, tie it to the casting and then tie the other end of this rope to the rope that is used to raise the flag up and down the pole.

Another method used is to insert a doubled over section of rope through the hole in the flag holder and then pull the flag holder itself through the loop that is formed by the rope inserted through it.

A problem with this is that when the rope is pulled snug the flag holder will be in a plane that is more parallel with the vertical axis of the pole, and hence the flag, than perpendicular to it.

Some flag holders have changed the flat spring clip to a spring loaded part that opens and closes more readily. Another improvement in these is that the separate hole for attaching the rope has been removed This design is essentially an elongated letter C with a hinged bar across the opening that hinges inward to make an opening for the flag to enter and exit. This design is better in that a loop of rope can be slipped over the hook end of the flag holder. This assembly uses intricately machined parts and additionally when the flag holder is attached to the rope it is in a plane more parallel to the vertical axis of the flagpole than perpendicular to it.

In each of these designs the entrance hole for placing the flag through is small and the part that rotates in to allow the flag to enter and exit moves into the area where the flag immediately around the flag eyelet is and can interfere with moving it out or in.

In cold weather it can be especially difficult to grab the flag and flag holder and push the part on the flag holder that moves in and pull the flag off or put the flag on. In cold rainy weather this can be especially difficult as ice becomes a pan of the flag around the eyelet and it becomes difficult to push the part of the flag holder that moves in and pull the flag off. If wind is added to the situation it becomes more difficult with the flag blowing.

Another problem is that the flag can wrap around the pole. With present designs if the wind blows the flag will extend out at an angle centered on the flag pole rope. If the wind is blowing directly at the flag holders from the flag holder side of the pole the flag will be blowing toward the pole and will actually be rubbing on it. If the wind then shifts the wrong way the flag will wrap around the pole.

Another problem with flags is that if the rope is left slack the flag can blow, with the rope, a considerable distance from the pole. Also if during raising or lowering the flag, the rope is dropped and the wind is blowing hard the flag can blow way out from the pole taking the rope with it.

All of these things are dealt with routinely, often by custodial personnel. Decorum is a major consideration. The personnel are concerned with the appearance of the flag and with their own appearance while putting it up and taking it down.

SUMMARY OF THE INVENTION

To avoid the limitations and problems with present flag holders, it is an object of the subject invention to increase the angle that the flag can rotate around the pole without wrapping around it.

Another object of the invention is to provide a flag holder that will result in the flag flying at an angle originating from the center of the pole as opposed to the center of the flag pole rope.

Another object of the invention is to provide a flag holder that will provide for attaching and removing the flag more easily.

Another object of the invention is to provide a flag holder that is easily attached to the rope and pulley system.

Another object of the invention is to provide a flag holder that will hold the flag at substantially equal distances from the pole at both the bottom and top of the flag and prevent the flag from blowing away from the pole should the rope! be left slack or if it be let loose during raising or lowering the flag.

Another object of the invention is to provide a flagholder that is designed without pans, such as hinges, that can wear out or break.

These and other objects are provided by a novel flag holder that is a member attached to a flag pole rope, going around the flag pole and return rope and going through the flag eyelet and attaching to its own opposing end or at a point adjacent to it that moves with it.

DESCRIPTION OF THE PREFERRED EMBODIMENT

Figure 1:
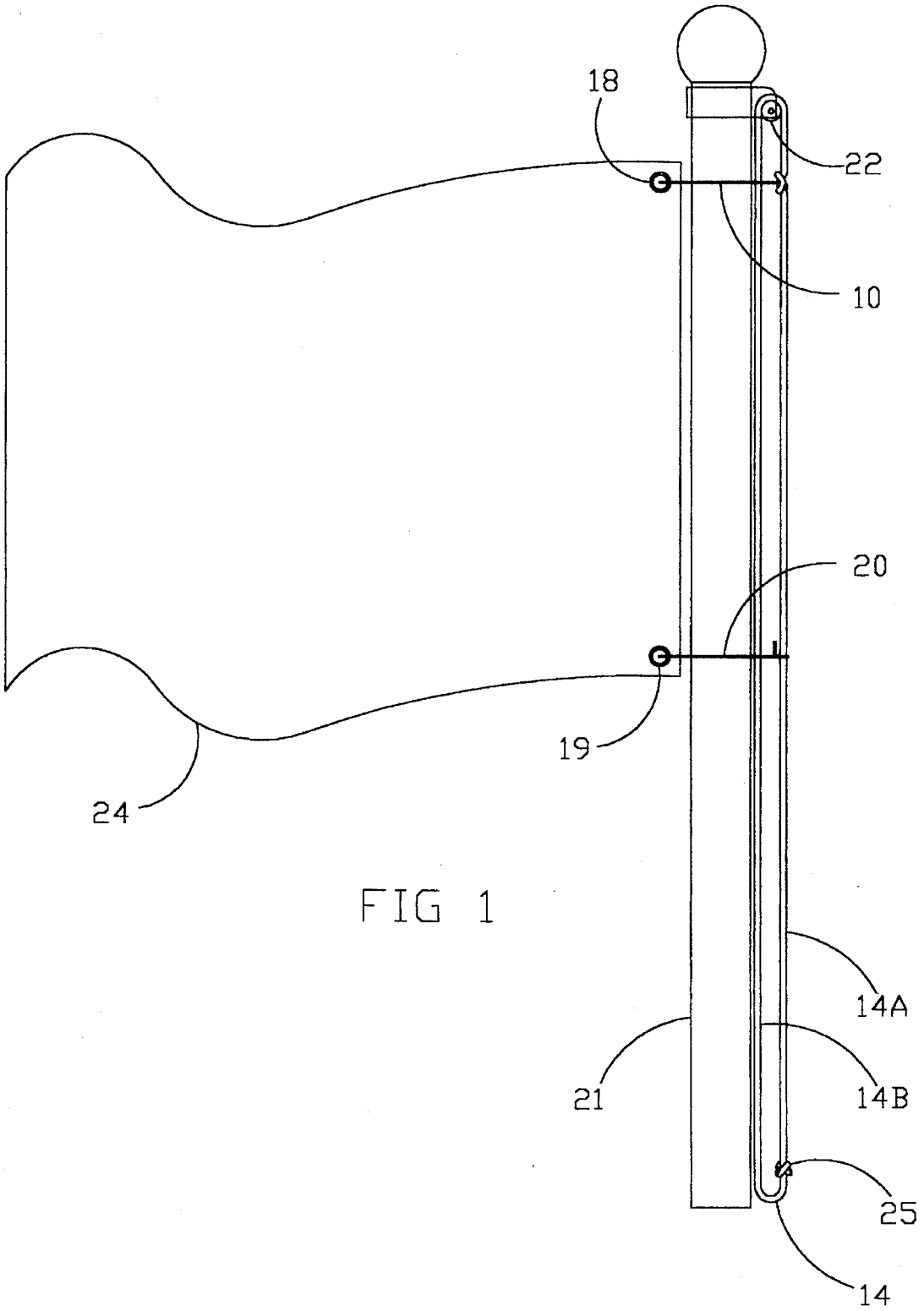
FIG. 1 is an elevation view of a flag hanging from a pole using the flag holding rings.

Referring to FIG. 1, a Top or first Flag Ring 10 and a Bottom or second Flag Ring 20 are shown attached to a rope or halyard 14 and a flag 24 through eyelets 18 and 19. Said rope 14 is attached to a flag pole 21 by a pulley assembly 22 which varies in design, but is attached to said flag pole 21 near the top and allows said rope 14 to carry flag holders up and down a pole while holding said flag 24. Said rope is generally ¼ to ⅜ inch diameter braided nylon and it includes a first halyard portion 14*a* on one side of the pulley 22 and a second halyard portion 14*b* on the other side of the pulley 22.

Figure 2:
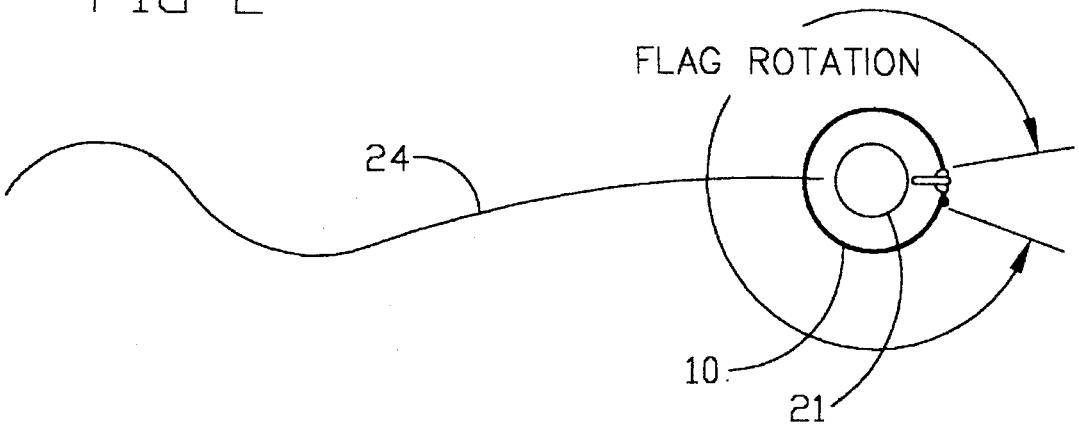
FIG. 2, is a bottom view of a flag hanging from a pole using the flag holding rings.

Referring to FIG. 2, Said Flag 24 is able to rotate around a substantial portion of said flag pole 21 on a radius that originates substantially close to the center of said flag pole 21.

Figure 3:
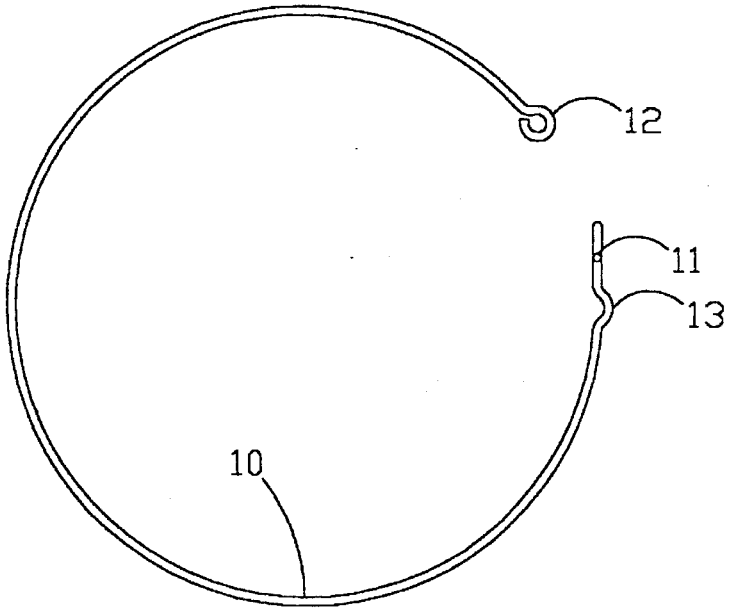
FIG. 3 is a top view of the flag holding ring used at the top of the flag.
Figure 11:
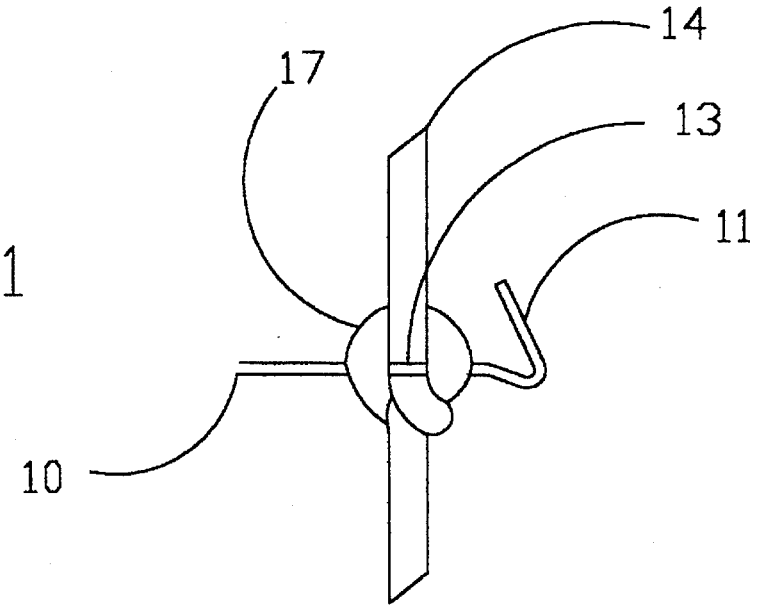
FIG. 11 is a side view of FIG. 9 taken along line 11—11.
Figure 12:
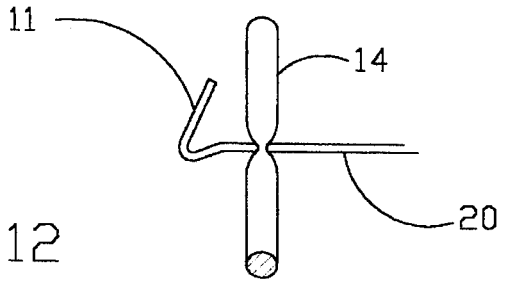
FIG. 12 is a section through FIG. 10 taken along line 12—12.

Referring to FIG. 3, a Top Flag Ring 10 for holding flags includes a hook 11 at one end, an eye 12 at the other end, and an indent or slot 13. FIG. 11 further shows the configuration of hook 11. Said Top Flag Ring 10 is a wire form made of resilient material that will allow spreading the opening between hook 11 and eye 12 to a minimum of 75% of the original diameter of the Top Flag Ring 10 without substantially permanently deforming said part in order to allow it to slip over the diameter of said flag pole 21.

Figure 5:
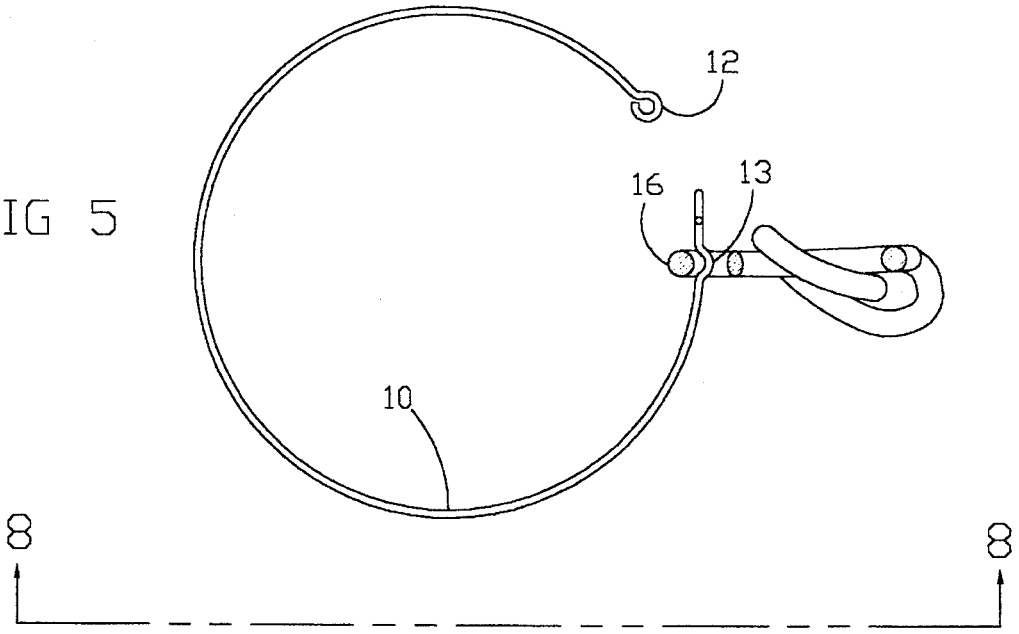
FIG. 5 is a top view of the top flag holding ring showing the attachment to the rope before the rope is pulled tight forming a knot.
Figure 6:
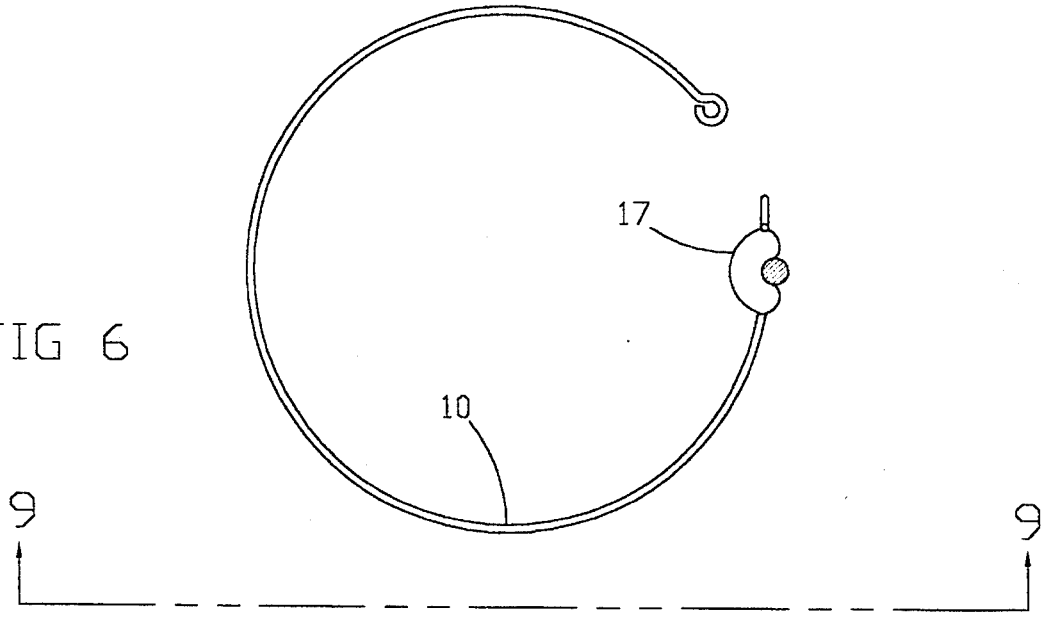
FIG. 6 is the same view as FIG. 5 with the rope pulled tight forming a knot.
Figure 8:
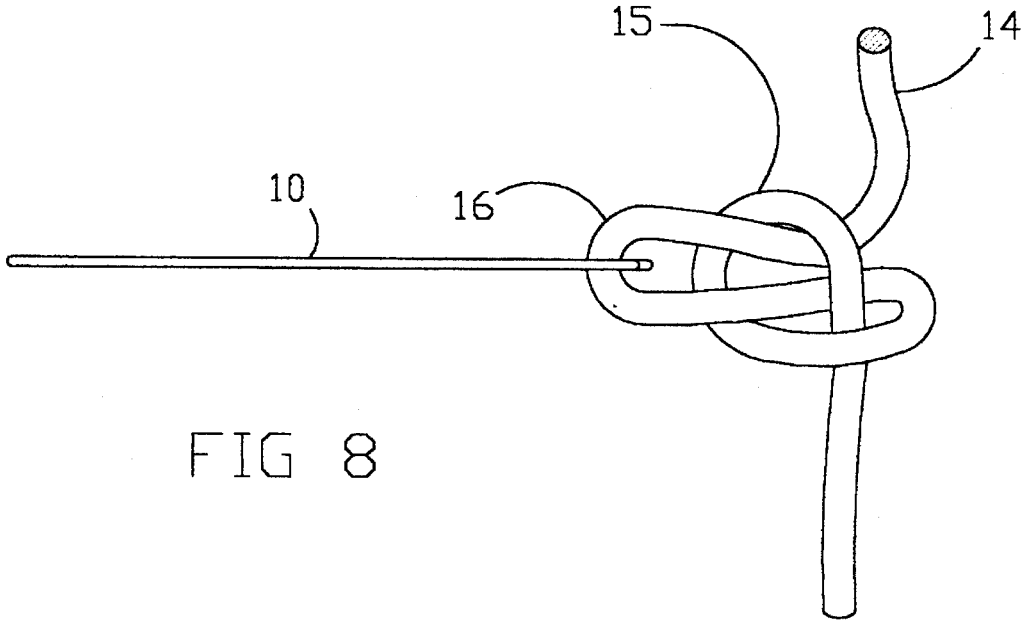
FIG. 8 is a side view of FIG. 5 taken along line 8—8.
Figure 9:
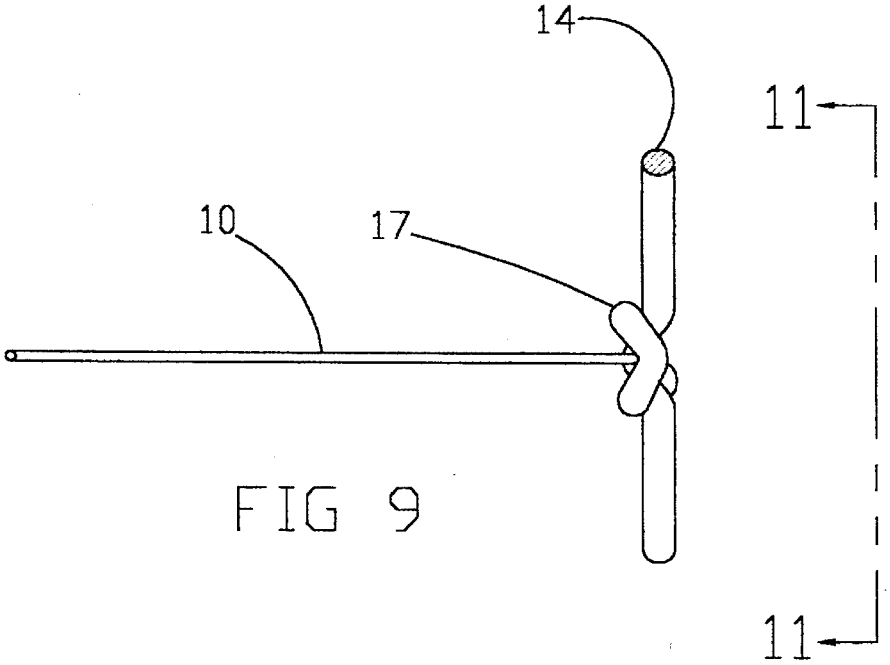
FIG. 9 is a side view of FIG. 6 taken along line 9—9.
Figure 10:
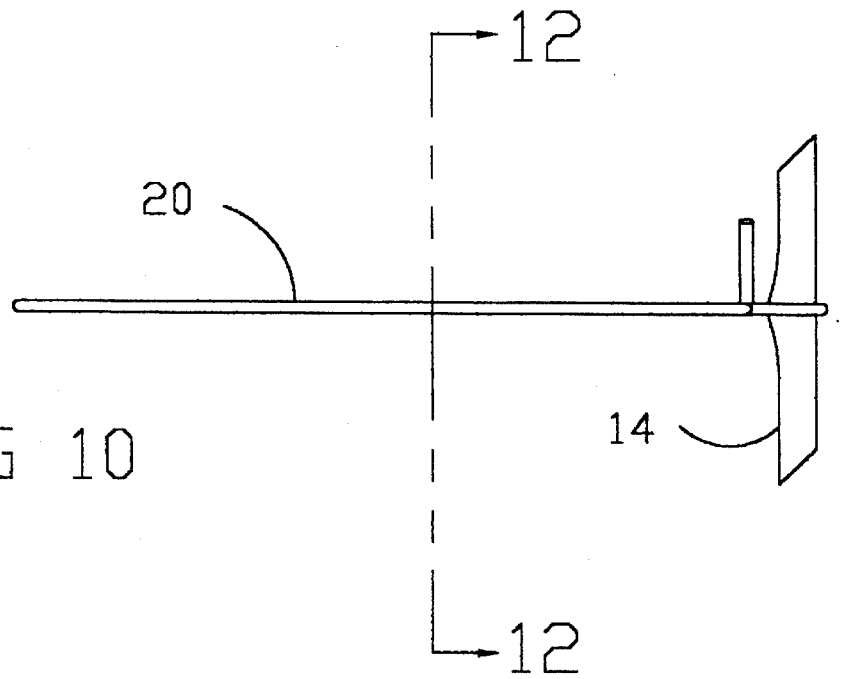
FIG. 10 is a side view of FIG. 7 taken along line 10—10.

Referring to FIG. 8, said rope 14 is shown from the side with a loop 16 pulled through; a loop 15. Referring to FIG. 5, which has a section of said loop 16 cut out for clarity, Top Flag Ring 10 is inserted through said loop 16 to said indent 13 and referring to FIG. 11, said indent 13 serves as a locator for said rope loop 16 and also referring to FIG. 9, serves to allow the knot 17, formed in the rope 14 when it's ends are pulled tight, to be consistant in shape and to direct the Top Flag Ring 10 at a substantially right angle with respect to the flag rope 14 and hence the flag pole 21, as shown in FIG. 1.

Figure 4:
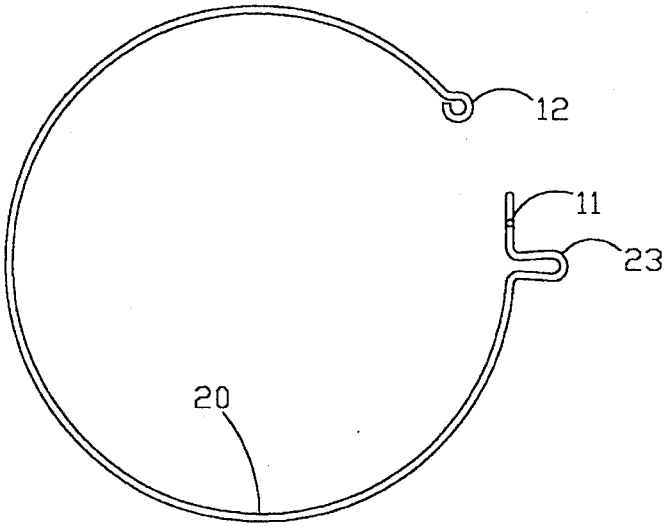
FIG. 4 is a top view of the flag holding ring used on the flag eyelet in the bottom of the flag.
Figure 7:
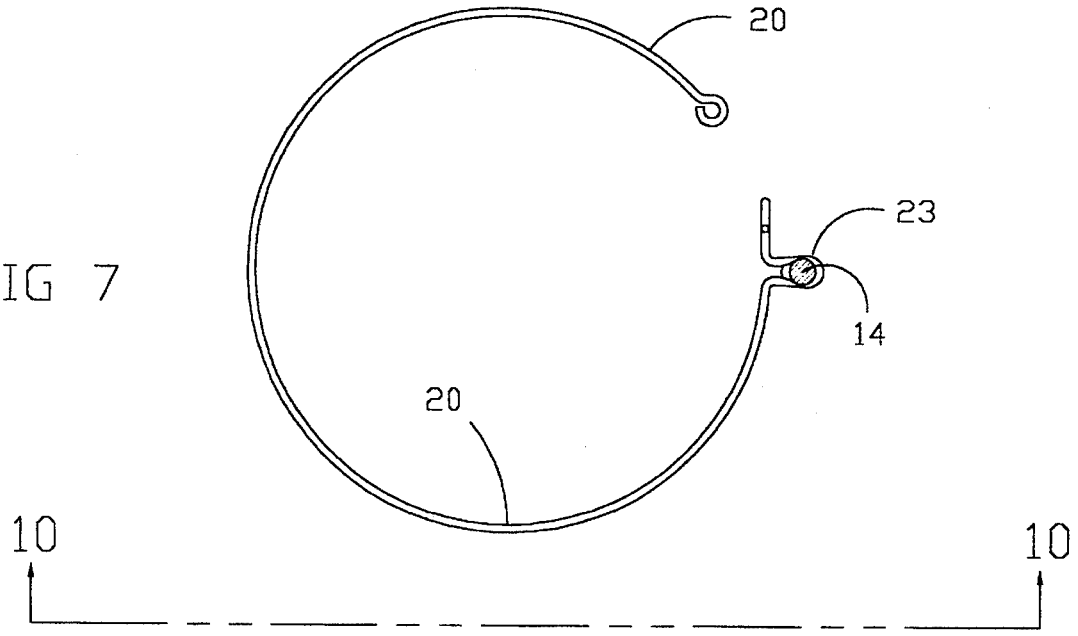
FIG. 7 is a top view of the bottom flag holding ring attached to the flag rope by slipping the rope into a slot formed on the circumference of the said bottom flag holding ring.

Referring to FIG. 4, Bottom Flag Ring 20 is shown. This Bottom Flag Ring 20 is substantially identical to Top Flag Ring 10, excepting that it has the indent or slot 13 shown in FIG. 3, replaced by an elongated slot 23. In this said Bottom Flag Ring 20 attachment of rope 14, is made by slipping said rope 14 into said slot 23 as shown in FIG. 7. Said slot 23 is narrowed at the entrance to retain said rope 14 in said slot 23.

Referring to FIG. 1, installation of Top Flag Ring 10, Bottom Flag Ring 20, and Flag 24 is accomplished as follows. Top Flag Ring 10 is attached to first halyard portion 14*a* as previously described. Top Flag Ring 10 as shown in FIG. 3, is then spread open between hook 11 and eyelet 12 and placed around, referring back to FIG. 1, flag pole 21 and the second halyard portion 14*b*. Then, eyelet 18 of Flag 24 is placed over, referring back to FIG. 3, eye 12 and then eye 12 is placed over hook 11. The Flag 24 is now attached at top eyelet 18 and can be raised to a position on the flag pole 21 where flag eyelet 19 is at a level for convenience in attaching the Bottom Flag Holder 20. The resiliency of the wire of ring 10 biases the hook and eye into locking engagement with each other.

Referring to FIG. 4, Bottom Flag Holder 20 is spread apart between eye 12 and hook 11 and placed around, referring back to FIG. 1, flag pole 21 and second halyard portion 14*b*. At this point, referring back to FIG. 4, eye 12 is placed through, referring to FIG. 1, flag eyelet 19 and referring back to FIG. 4, eye 12 is placed over hook 11. Referring to FIG. 7, first halyard portion 14*a* is inserted in slot 23 for frictional securement therein. Referring to FIG. 1 Bottom Flag Holder 20 can be slipped up or down flag rope 14 to achieve a distance between the Top Flag Holder 10 and Bottom Flag Holder 20 that is substantially equal to that between flag eyelets 18 and 19.

Raising the flag is accomplished as normally done, by pulling rope 14 until the flag reachs the top of the pole 2 1 or any other point on said pole 21. Removal of the flag is accomplished by lowering the flag 24 and pulling eyes 12, of 10 and 20, off hooks 13, of 10 and 20, and pulling flag eyelets 18 and 19 off Flag Rings 10 and 20.

It should be appreciated that a set up similar to that shown in FIG. 1, could be made using two of the Top Flag Holders 10, with two of the knots 17.

It should be apprecitated that a set up similar to that shown in FIG. 8, could be made using two of the Bottom Flag Holders 20. In this case the Bottom Flag Holder 20 used on the top flag eyelet 18 could be inserted over rope 14 at a point just above the knot 25 used to tie rope 14 together at the ends to form an endless loop as shown in FIG. 1. This would insure that the point of attachment of the flag holder could not slide down the rope.

It should also be appreciated that a single flag holder with an indent and slot corresponding to indent 13 and slot 23 on the same ring could be made.

Figure 13:
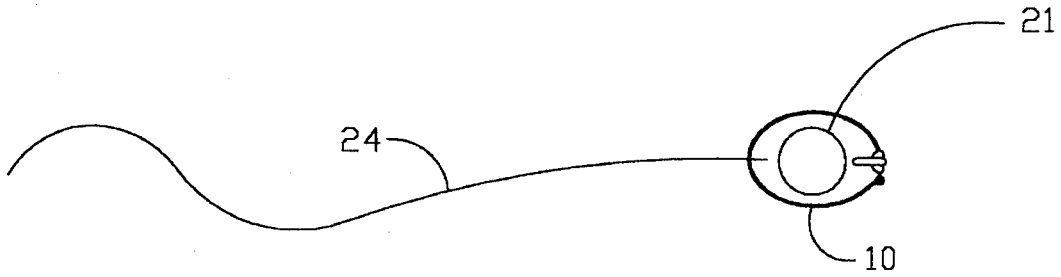
FIG. 13, is a bottom view of a flag hanging from a pole using elliptically shaped flag holding rings.

Another embodiment of this invention is shown in FIG. 13. This embodiment would have the Flag Ring Holders 10 and 20 elliptically shaped. This shape would keep the flag 24 at a more constant distance from the pole 21 as it, flag 24, moves around the pole 21 due to wind direction changes.

Another embodiment of this invention would use a flexible ring of cable or rope for the flag ring and have parts attached at the ends to provide the eye and hook components.

Another method of attachment would have the flag ting at the bottom of the flag remain unattached to the rope entirely but going through the Flag Eyelet 19 and around the flagpole 21 and flagropes 14 and closing on its ends as previously described.

Although the invention is described with respect to a preferred embodiment, modifications thereto will be apparent to those skilled in the art. Therefore, the scope of the invention is to be determined by reference to the claims which follow:

I claim:

1. A flagstaff assembly comprising:

a flag pole having an upper end;

a pulley attached to the upper end of said flag pole;

a closed loop halyard secured to said pulley and movable therewith, said closed loop halyard having a first halyard portion on one side of said pulley and a second halyard portion on the other side of said pulley;

a first closed ring attached to said first halyard portion of said closed loop halyard, said first closed ring extending around both said flag pole and said second halyard portion of said closed loop halyard; and a flag having a first eyelet, said first closed ring extending through said first eyelet.

2. The flagstaff assembly according to claim 1, further comprising:

a second eyelet in said flag, said second eyelet being spaced from said first eyelet; and a second closed ring extending around both said flag pole and said second halyard portion of said closed loop halyard, said second closed ring extending through said second eyelet.

3. The flagstaff assembly according to claim 2, wherein said second closed ring extends around said first halyard portion of said closed loop halyard.

4. The flagstaff assembly according to claim 2, wherein said second closed ring is attached to said first halyard portion of said closed loop halyard.

5. The flagstaff assembly according to claim 2, wherein said flag is able to rotate partially around said flag pole by movement of said first and second eyelets upon said first and second closed rings, respectively.

6. The flagstaff assembly according to claim 2, wherein said second closed ring is fabricated from a length of wire having a first end and a second end removably attached to each other.

7. The flagstaff assembly according to claim 6, wherein said length of wire is a resilient material, wherein said first and second ends of said wire may be separated from each other for placement of said wire around said flag pole.

8. The flagstaff assembly according to claim 7, wherein said first end of said wire is a hook and said second end of said wire is an eye.

9. The flagstaff according to claim 8, wherein the resiliency of said wire biases said hook into locking engagement with said eye.

10. The flagstaff according to claim 9, further comprising a second slot within said second closed ring, said first halyard portion of said closed loop halyard being tied to the portion of said second ring that forms said second slot.

11. The flagstaff according to claim 9, wherein said second closed ring is elliptical and the second closed ring is attached to said first halyard portion of said closed loop halyard along the major axis of the elliptical second closed ring.

12. The flagstaff according to claim 9, further comprising a second slot within said second closed ring, said second slot frictionally securing therein said first halyard portion of said closed loop halyard, said first halyard portion being slidable within said second slot.

13. The flagstaff according to claim 12, wherein said second slot includes an entrance that is narrower than the rest of said slot.

14. The flagstaff assembly according to claim 1, wherein said first closed ring is fabricated from a length of wire having a first end and a second end removably attached to each other.

15. The flagstaff assembly according to claim 14, wherein said length of wire is a resilient material, wherein said first and second ends of said wire may be separated from each other for placement of said wire around said flag pole.

16. The flagstaff assembly according to claim 15, wherein said first end of said wire is a hook and said second end of said wire is an eye.

17. The flagstaff according to claim 16, wherein the resiliency of said wire biases said hook into locking engagement with said eye.

18. The flagstaff according to claim 17, wherein said first closed ring is elliptical, the attachment of said first closed ring and said first halyard portion of said closed loop halyard being along the major axis of the elliptical first closed ring.

19. The flagstaff according to claim 17, further comprising a first slot within said first closed ring, the attachment between said first closed ring and said first halyard portion of said closed loop halyard resulting from said first halyard portion of said closed loop halyard being secured, by tying, to the portion of said first closed ring that forms said first slot.

20. The flagstaff according to claim 17, further comprising a first slot within said first closed ring, the attachment between said first closed ring and said first halyard portion of said closed loop halyard resulting from said first slot frictionally securing therein said first halyard portion of said closed loop halyard, said first halyard portion being slidable within said first slot.

* * * * *